United States Patent [19]

Soule

[11] Patent Number: 4,585,173

[45] Date of Patent: Apr. 29, 1986

[54] PRESSURE ACTIVATED CONICAL SPRAY NOZZLE

[75] Inventor: Lincoln S. Soule, Wendell, Mass.

[73] Assignee: Bete Fog Nozzle, Inc., Greenfield, Mass.

[21] Appl. No.: 712,841

[22] Filed: Mar. 18, 1985

[51] Int. Cl.[4] ..... A62C 35/00; B05B 1/06

[52] U.S. Cl. ..... 239/453; 239/459; 239/533.1

[58] Field of Search ..... 239/452, 453, 456, 459, 239/501, 533.1, 533.12, 533.15, 570

[56] References Cited

U.S. PATENT DOCUMENTS

| | | | |
|---|---|---|---|
| 2,338,744 | 1/1944 | Szekely | 239/456 X |
| 4,394,972 | 7/1983 | Potter | 239/453 |
| 4,456,181 | 6/1984 | Burnham | 239/501 X |

*Primary Examiner*—Andres Kashnikow

*Attorney, Agent, or Firm*—Chapin, Neal & Dempsey

[57] ABSTRACT

A nozzle is pressure activated to generate a fine droplet, conical spray. The nozzle has an outer tubular body with a fluid inlet opening at one end and a discharge opening at its opposite end. Coaxially disposed within the body is a conduit for carrying fluid from the inlet to the discharge opening. Adjacent the inlet end of the nozzle, the conduit includes an annular flange with fluid seal between the peripheral edge of the flange and the inner wall of the nozzle body. The conduit is axially movable within the tubular body over a predetermined distance. Adjacent the discharge end of the nozzle is a helical opening through the wall of the conduit. The helical opening is spaced for the discharge end of the conduit less than the extent of axial movement of the conduit. A closure plate is disposed at the outer end of the conduit for shutting off flow of fluid through the nozzle. A coil spring is disposed about the conduit and has one end engaged with a wall portion of the nozzle body and its opposite end is engaged with the inner surface of the flange for releasably urging the conduit toward the inlet opening to maintain the closure plate in nozzle closing relation at the discharge end of the nozzle.

7 Claims, 2 Drawing Figures

PRESSURE ACTIVATED CONICAL SPRAY NOZZLE

BACKGROUND OF THE INVENTION

This invention relates to liquid spray nozzles and, in particular, to nozzles of the type used for generating fine droplet, conical sprays such as utilized in fire control spray systems as used on flight decks of naval aircraft carriers.

More particularly, nozzles of the type embodying this invention are pressure activated so that when liquid under pressure is supplied to the inlet opening, a spray generating helical component within the nozzle is automatically extended to its operating position.

Pressure responsive fluid nozzles have been heretofore disclosed in the prior art for various purposes, including fuel injection nozzles for internal combustion engines and atomizing nozzles. U.S. Patents disclosing such nozzles includes Nos. 1,833,748; 1,879,012; 2,338,744; 3,801,021 and 4,394,972. While these patents relate to pressure activated spray nozzles, they do not disclose any nozzle which includes a helical vane adapted by axial movement thereof to be extended from the nozzle body to generate a fine droplet, conical spray uniquely adapted for fire fighting purposes.

In a prior U.S. Pat. No. 4,456,181 assigned to the same assignee of the instant application, a gas and liquid mixing nozzle is disclosed for an abrasive type slurry which includes a stationary helical insert constructed to form a conical spray adapted for use in stack gas scrubber applications.

It is the principal object of this invention to provide an improved conical spray nozzle which includes a reciprocably movable spray generating element which is extendable to its spray generating position in response to the fluid input pressure of the liquid to be sprayed.

It is another object of this invention to provide an improved conical spray nozzle uniquely adapted to be used in fire fighting applications on the flight deck of aircraft carriers and similar installations.

It is a further object of this invention to provide a conical spray nozzle in which a liquid carrying conduit is axially movable within the nozzle.

Figure 2:
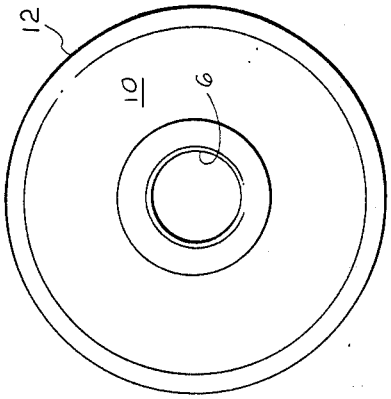
Figure 1:
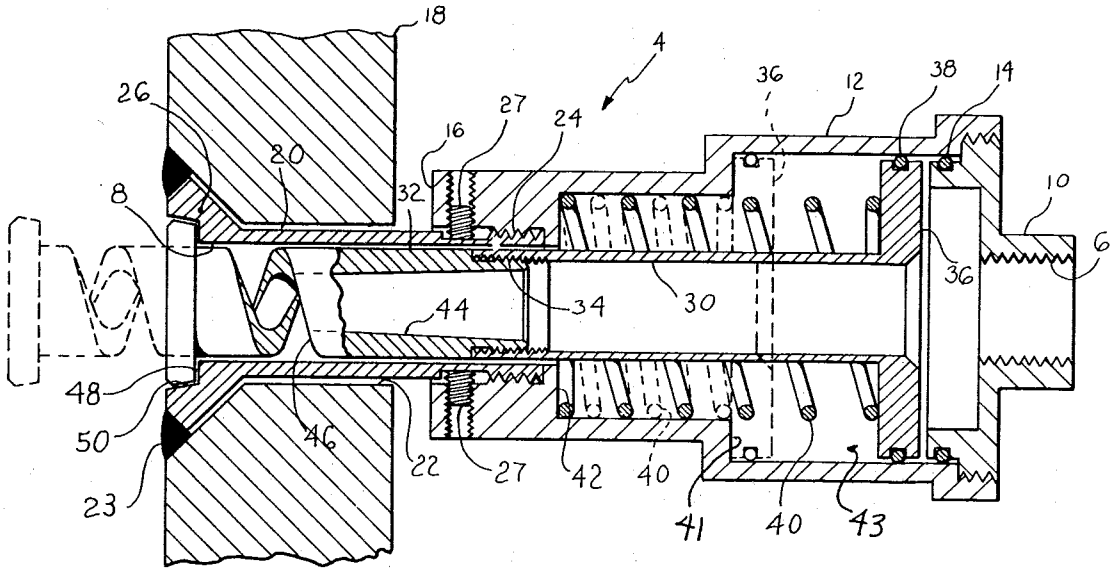

The above and other objects and advantages of this invention will be more fully appreciated by a reading of the following description in conjunction with the accompanying drawing in which:

FIG. 1 is an elevational view, partly in cross-section, of a spray nozzle of the type embodying this invention, and FIG. 2 is an end view showing the inlet end of the nozzle as shown in FIG. 1.

Referring in detail to the drawing, in FIG. 1 is shown a spray nozzle indicated generally at 4. The nozzle includes an inlet opening or port 6 for liquid at one end and a liquid discharge opening 8 at the opposite end of the nozzle.

An internally threaded coupling or end plate fitting 10 is screw-fitted into one end of an outer sleeve or tubular barrel 12 of the nozzle. A sealing ring 14 is provided to ensure a fluid tight seal between the end plate 10 and the nozzle barrel 12.

The barrel 12 of the nozzle is of generally cylindrical construction and has a radially stepped tubular construction with its largest diameter disposed toward the inlet port 6 and its smallest diameter disposed toward the outlet end of the nozzle. The barrel 12 terminates at end wall 16 in spaced relation to a bulkhead represented at 18. By simply rotating the nozzle axis and bulkhead 90 degrees, the nozzle would be adapted for installations in the deck 18 of a vessel, such as a naval aircraft carrier. The nozzle includes tubular sheath 20 which extends through an opening 22 provided through bulkhead or deck 18. The nozzle may be affixed to the deck, such as by welding as shown at 23.

The sheath 20 has its inner end screw-fitted, as at 24, into the inner end of the barrel 12 and in effect, the sheath and barrel provide the fixed outer barrel structure of the nozzle. Radially extending set-screws 27 securely fasten the sheath 20 and barrel 12 in end-to-end relationship. This separable outer barrel nozzle construction greatly facilitates initial installation and disassembly of such nozzle for repair or replacement. The outer end of the sheath includes an enlarged bead or rim 26 of flared configuration.

Coaxially disposed within the outer barrel portions of the nozzle is a tubular conduit 30 and a tubular spray element 32 fastened together in end-to-end relationship as by a threaded connection illustrated at 34, thereby providing a continuous passage or conduit for liquid from the inlet opening 6 to the discharge opening 8 of the nozzle.

An annular flange 36 is carried on one end of the tubular conduit 30 and an O-ring 38 provides a fluid tight seal between the inner wall of the barrel 12 and the peripheral edge of the flange 36. The flange 36 serves as a piston for causing axial movement of the tubular conduit members 30 and 32 in response to the fluid pressure of liquid entering the inlet opening 6. The inner diameter of conduit 30 is relatively larger, on the order of $\frac{5}{8}''$ so that high volume liquid flow will be supplied to the helical spray member. The bore of conduit 32 is tapered inwardly to a substantially smaller inner diameter.

A coil spring 40 is fitted about the conduit 30 and has one end disposed against the inner surface of flange 36 and its opposite end engaged with radial shoulder 42 within the barrel 12. The spring releasably urges the piston toward the inlet opening of the nozzle. The upstream surface area of the piston 36 and the compression strength of spring 40 are selected so that a fluid inlet pressure of about 8–12 pounds per square inch will cause the piston to compress the spring fully to its dotted line position of FIG. 1 when the piston contacts shoulder 41 within the barrel 12.

The inner annular chamber 43 of the barrel portion of the nozzle surrounding the conduit formed by tubular elements 30 and 32 is separated longitudinally into liquid and air filled chambers of varying volume defined by the longitudinal position of piston element 36. It should be realized that the air chamber containing the spring 40 must not be made airtight so that as the piston 36 is moved by fluid pressure compressing spring 40, air will be allowed to bleed from the barrel so that the air in chamber 43 will not be compressed.

Adjacent the discharge end of the nozzle, the liquid conduit formed by the tubular members 30 and 32 includes a helically extending opening 46 formed in the outer end portion of the spray member 32. As shown, the helical opening 46 extends into the bore 44 of the conduit for approximately one complete turn of 360 degrees from its inner to outer end. The pitch of the helix may vary but a pitch from one to four turns per inch axially of the nozzle has resulted in suitable spray generation for purposes of this invention. The inner bore 44 of the spray member has a gradually tapered diameter from its inner to its outer end whereby, at the helical cutout section of the spray, the wall thickness is of gradually increasing thickness. The taper of bore 44 restricts the flow of liquid from larger inner bore 30 and thus helps in maintaining sufficient fluid pressure on piston 36 to hold the nozzle "open." The upstream surface defined by helical cutout 46, in effect, provides a helical vane having generally planar surfaces facing the upstream end of the nozzle so that liquid striking the helical vane surface will be deflected outwardly into a fine droplet, generally conical spray which is approximately symmetrical about the axis of the nozzle.

The outer end of spray forming element 32 includes a transverse flange 48 generally perpendicular to the nozzle axis. The flange 48 serves as an end cap, cover or closure member for the nozzle which is dimensioned so that its peripheral edge will fit within annular recess 50 provided at the corner edge portion of the enlarged bead 26 of sheath 20. When the nozzle is not in operation, spring 40 will force the flange 36 to its retracted position and flange 48 will fit snugly within recess 50 in generally coplanar relationship with the outer surface of the deck or bulkhead 18 so as not to interfere with the normal flight deck traffic.

When water, under sufficient fluid pressure, is introduced into the nozzle at inlet port 6, the pressure on the upstream face of piston 36 will cause the piston 36 to move, compressing spring 40 to the dotted line showing of FIG. 1. The longitudinal stroke of the piston 36 is of sufficient length so that the helical vane portion of the conduit will be disposed outwardly of the outer surface of deck 18, as illustrated in the dotted line showing at FIG. 1. The water flowing through conduit 30 and tapered bore 44 will flare outwardly at the helical opening 46 striking the upstream surfaces of the helical vane to form a fine droplet but high volume of conical spray.

Having thus described this invention, what is claimed is:

1. Liquid spray fire fighting nozzle for stationary installation having a liquid inlet opening and discharge opening comprising a generally cylindrical barrel, a liquid carrying conduit coaxially disposed within said barrel and extending from the inlet to the discharge opening of the nozzle, said conduit being axially movably disposed within the barrel, a piston carried adjacent one end of the conduit has its peripheral edge sealed for movement within the barrel, a helical opening being provided adjacent the discharge end of the conduit and means disposed within the barrel for releasably urging the conduit toward the inlet opening of the nozzle, said piston being axially movable a predetermined stroke distance, the helical opening being disposed so that movement of the piston in response to pressurized liquid flow entering the inlet opening of the nozzle will result in the helical opening being extended beyond the discharge end of the barrel to provide a conical liquid spray.

2. Liquid spray fire fighting nozzle as set forth in claim 1, in which said helical opening is provided in a cylindrical member which communicates with the inlet opening of the nozzle and forms a portion of the axially movable conduit, said cylindrical member having a tapered bore of diminishing inner diameter toward the discharge end of the nozzle, said helical opening defining through the wall a helical liquid deflecting vane adjacent the end of the liquid carrying conduit.

3. Liquid spray fire fighting nozzle as set forth in claim 2, in which said piston comprises an annular flange carried on the conduit adjacent the inlet end of the nozzle, a coil spring engaged with the inner surface of the flange to urge the piston and liquid carrying conduit toward the inlet opening of the nozzle, the discharge end of the conduit having a transverse flange on the outer end thereof adapted to close the discharge opening of the nozzle.

4. Liquid spray fire fighting nozzle as set forth in claim 3, in which said helical opening extends over at least one revolution about the conduit, said helical opening being disposed inwardly of the transverse flange a distance not substantially greater than the length of the pressure stroke of said piston whereby the helical portion of the conduit will be extended outwardly of the barrel when the piston is moved by liquid pressure over its stroke distance.

5. Liquid spray fire fighting nozzle as set forth in claim 4, in which the barrel includes a liquid chamber portion and air chamber portion of varying volume defined by said piston, and means for venting the air chamber during the pressure stroke of the piston.

6. Liquid spray fire fighting nozzle as set forth in claim 5, in which the barrel portion of the nozzle extends through an opening in the deck or bulkhead of a vessel or the like, said barrel being affixed to the deck or bulkhead such that the closure flange is generally coplanar to the outer surface thereof when the nozzle is in its closed condition.

7. Liquid spray fire fighting nozzle as set forth in claim 5, in which the surface area of the piston facing the inlet opening and the compression strength of the spring are selected so that the piston is adapted to compress the spring and move axially over its full stroke distance in response to liquid inlet pressure of at least ten pounds per square inch.

* * * * *